United States Patent [19]

Goodrich

[11] Patent Number: 4,639,307

[45] Date of Patent: Jan. 27, 1987

[54] METHOD FOR PRODUCING INDUSTRIAL ASPHALTS

[75] Inventor: Judson E. Goodrich, San Rafael, Calif.

[73] Assignee: Chevron Research Company, San Francisco, Calif.

[21] Appl. No.: 646,397

[22] Filed: Aug. 31, 1984

[51] Int. Cl.[4] ..... C08L 95/00; C10C 1/20; C10C 3/02

[52] U.S. Cl. ..... 208/44; 106/273 R; 106/284; 208/39

[58] Field of Search ..... 208/44; 106/273 R, 284, 106/273

[56] References Cited

U.S. PATENT DOCUMENTS

| | | | |
|---|---|---|---|
| 1,720,487 | 7/1929 | Lichtenstern | 208/45 |
| 2,069,314 | 2/1937 | Hunt et al. | 208/44 |
| 2,268,602 | 1/1942 | Lichtenstern | 208/44 |
| 2,272,866 | 2/1942 | Burk et al. | 208/44 |
| 2,287,511 | 6/1942 | Burk et al. | 208/44 |
| 2,430,546 | 11/1947 | Jamieson | 106/273 R |
| 2,776,933 | 1/1957 | Gossen | 208/44 |
| 3,130,144 | 4/1964 | Bostwick et al. | 208/44 |
| 3,223,618 | 12/1965 | Convery et al. | 208/44 |
| 3,244,543 | 4/1966 | Lifson et al. | 208/44 |
| 3,258,418 | 6/1966 | Pitchford et al. | 208/44 |
| 3,919,072 | 11/1975 | Pitchford et al. | 208/44 |
| 4,338,137 | 7/1982 | Goodrich | 106/273 R |

*Primary Examiner*—Andrew H. Metz
*Assistant Examiner*—Helane Myers
*Attorney, Agent, or Firm*—S. R. LaPaglia; R. C. Gaffney; J. J. DeYoung

[57] ABSTRACT

Disclosed is a one-step method of producing an industrial asphalt from a bituminous material which comprises mixing together without air-blowing:

(a) a feed material comprising a bituminous material having a viscosity of at least 50 centistokes at 350 degrees Fahrenheit and wherein the feed petroleum residuum forms a single phase when mixed with 5 percent ferric chloride; and (b) from about 0.1 to 20.0 percent by weight of ferric chloride, said mixing being done at a temperature in the range of 351 to 600 degrees Fahrenheit, whereby the softening point of the feed is substantially increased and the penetration is significantly decreased.

1 Claim, 1 Drawing Figure

SOFTENING POINT AND PENETRATION RANGES OF INDUSTRIAL ASPHALT GRADES

METHOD FOR PRODUCING INDUSTRIAL ASPHALTS

BACKGROUND OF THE INVENTION

The present invention relates to a method for modifying the physical properties of bituminous materials and to asphalt compositions obtained therefrom. More particularly, the present invention relates to a method of producing industrial asphalts. Industrial asphalts have many uses but are particularly useful in roofing applications.

The physical properties of asphalt vary over a wide range. FIG. 1 is a softening point-penetration plot for various industrial asphalt grades. The four rectangles in FIG. 1 outline the properties of Types I–IV industrial asphalts as defined by the American Society for Testing and Materials (ASTM-D312). The plot illustrates the tremendously varying properties required of industrial asphalts for different applications. Industrial asphalts have softening points above 135 degrees Fahrenheit.

Properties of bituminous materials may be modified by such well-known treating means as solvent extraction, air-blowing and the like.

Air-blowing processes using catalysts are known in the art for making industrial asphalts. However, air-blowing processes require complex and expensive air-blowing equipment which must meet ever more stringent air pollution regulations. Furthermore, air-blowing requires long processing times on the order of hours.

U.S. Pat. No. 3,751,278 discloses a process for treating asphalts without air-blowinge using phosphoric acids having an H3PO4 equivalent of greater than 100 percent. The compositions produced by this process are directed to paving asphalts particularly useful in highway construction and maintenance. Paving asphalts usually have softening points below 135 degrees Fahrenheit and penetrations from 20 to 300 dmm at 77 degrees Fahrenheit. This patented process is particularly directed to treating asphalts to substantially increase the viscosity without a significant decrease in penetration.

U.S. Pat. No. 2,179,208 teaches a process for making asphalt which comprises air-blowing in the absence of any catalyst at a temperature of 300 to 500 degrees Fahrenheit for 1 to 30 hours followed by a second step of heating that material to a temperature greater than 300 degrees Fahrenheit with a small amount of polymerizing catalysts. The catalysts include phosphoric acid, ferric chloride, BF3, etc. Using small amounts of these catalysts, products with melting points of 140 degrees Fahrenheit or less were produced. The patent teaches that overall processing times are significantly reduced using this two-step process.

Ferric chloride is a well-known catalyst for use in the air blowing of asphalt. See, for example, U.S. Pat. Nos. 1,782,186; 2,627,498 and 2,776,933.

One object of the present invention is to produce an industrial asphalt in a simple one-step process without any prior air-blowing treatment of the bituminous material feed stock or any post air-blowing treatment of the asphalt formed.

A second object of the present invention is to provide a process for producing industrial asphalts where treatment times are very short, in the order of 5 to 25 minutes or less.

Another object of the present invention is to provide a process which can utilize as a feed, bituminous materials which heretofore could not be used in making industrial asphalts by the prior art air-blowing process without the addition of substantial amounts of lower boiling hydrocarbons.

SUMMARY OF THE INVENTION

The present invention involves a one-step method of producing an industrial asphalt from a bituminous material which comprises mixing together without air-blowing:

(a) a feed comprising a bituminous material having a viscosity of at least 50 centistokes at 350 degrees Fahrenheit and wherein the feed bituminous material forms a single phase when mixed with 5 percent ferric chloride; and (b) from about 0.1 to 20.0 percent by weight of ferric chloride, said mixing being done at a temperature in the range of 351 to 600 degrees Fahrenheit whereby the softening point of the feed is substantially increased and the penetration is significantly decreased.

DETAILED DESCRIPTION OF THE INVENTION

Figure 1:
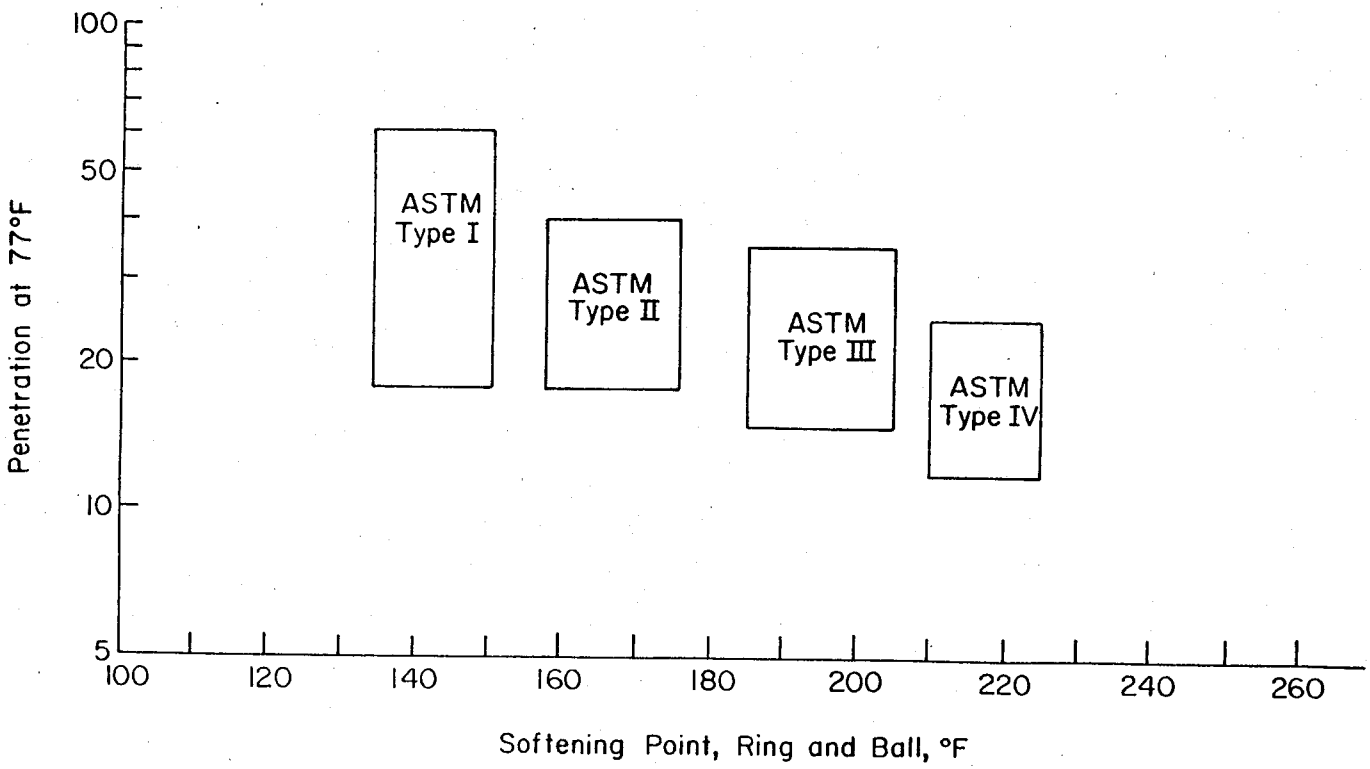

The industrial asphalts of the present invention are prepared by starting with particular bituminous materials and mixing them without air-blowing with ferric chloride to produce industrial asphalt. The product industrial asphalts of the present invention are formed in a one-step process without any air-blowing or other oxidation treatment of the starting material prior to or after treatment with ferric chloride.

Feeds suitable for use in the present invention called bituminous materials ("Bituminous Materials: Asphalts, Tars, and Pitches" Vol. I, A. J. Hoiberg, Editor, 1964, Interscience, pages 2–5, the disclosure of which is incorporated herein by reference) can be of varied character. Many petroleum residue (also known as fluxes) remaining following the separation of vaporizable hydrocarbons from oil fractions or any relatively high molecular weight extract obtained from petroleum refining or from naturally occurring hydrocarbons, including tar and Gilsonite, can be used.

It is critical for the one-step process of the present invention that the bituminous material feed stock have the following two characteristics:

(1) A viscosity of at least 50 centistokes when measured at 350 degrees Fahrenheit; and (2) Forms a single phase when mixed with 5 percent ferric chloride. It has been surprisingly found that feed stocks not meeting this critical parameter will not form industrial asphalts utilizing the simple one-step process of the present invention.

Generally the feed will have an initial viscosity at 350 degrees Fahrenheit of at least 50 cSt. In the process of the present invention, the softening point is substantially increased and the penetration point is significantly decreased thereby producing industrial asphalts. Generally, the feed flux will have a softening point in the range of 100 to 200 degrees Fahrenheit preferably 110 to 150 degrees Fahrenheit a penetration in the range 300 to 150, preferably 40 to 100 dmm at 77 degrees Fahrenheit. Generally, the viscosity of the feed is 50 to 200 cSt and more preferably 65 to 180 cSt. Particularly preferred feed materials include: petroleum distillation residue, a blend of hard petroleum distillation residue, a blend of Gilsonite, a blend of pitch from a solvent deasphalting process, a blend of pitch from a supercritical solvent deasphalting process. Any of the above blends can contain petroleum distillate or vegetable oil diluents.

One surprising feature of the present invention resides in the finding that by the critical selection of the bituminous material feed, one can produce industrial asphalts in a simple one-step process without prior or post-treatments involving air-blowing, characteristic of prior art processes.

The bituminous material feed stock is mixed with 0.1 to 20.0 percent by weight, preferably 0.2 to 12.0 percent and more preferably more than 0.5 and less than 10.0 percent by weight of ferric chloride. The quantity of ferric chloride to be utilized in the present invention is inversely proportional to the viscosity of the feed material. Thus, feed stocks having low viscosities, e.g., about 60 cSt. at 350 degrees Fahrenheit require larger amounts of catalyts e.g., about 8%. On the other hand, feed stocks having high viscosities, e.g., about 200 cSt. at 350 degrees Fahrenheit, need relatively lower amounts of catalyst e.g., about 0.5 to 2%. Ferric chloride is readily available commercially as anhydrous ferric chloride or hexa hydrate crystals. Aqueous solutions of various concentrations are also available or may be made by dissolving solid ferric chloride in water. In the present invention aqueous solutions are preferred.

The treating method of the present invention comprises heating the feed stock to a temperature in the range 351 to 600 degrees Fahrenheit, preferably 400 to 500 degrees Fahrenheit to facilitate mixing and reacting with the ferric chloride.

After the starting material has been heated to a temperature sufficient for mixing purposes, at least above its softening point, the ferric chloride is most often introduced into the hot feed with continuous agitation. Agitation is usually supplied by mechanical means and must be adequate to disperse the ferric chloride intimately throughout the asphalt. A preferred alternative process for mixing involves the use of in-line blending and a static mixer which further facilitate very short mixing and reaction time.

The present method of treating bituminous materials does not include air-blowing of the feed stock during mixing or as a part of the treatment, the treatment being carried out without passing air through the material either before, during or after treatment as is done in conventional prior art processes.

The entire one-step treatment process of the present invention requires from 1 to 30 minutes or more. Longer process times can also be utilized but are not necessary and are less economical. Preferably, the treatment time ranges from 5 to 25 minutes. Not included in the treatment time is the time required to initially heat the petroleum residue to treatment temperature.

In the process of the present invention the softening point of the feed asphalt is substantially increased and the penetration is significantly decreased. The amount of increase in the softening point and decrease in penetration will vary greatly depending upon the properties of the feed and the amount of ferric chloride used and the mixing temperature. Generally, it is desired to substantially increase the softening point by 50 to 120 degrees Fahrenheit, preferably 70 to 100 degrees Fahrenheit and significantly lower the penetration at 77 degrees Fahrenheit by 20 to 80 dmm, preferably 30 to 60 dmm.

The product industrial asphalts of the present invention will preferably have a softening point of 130 to 240 degrees Fahrenheit, and more preferably 200 to 235 degrees Fahrenheit with a penetration at 77 degrees Fahrenheit from 10 to 70 dmm, preferably 12 to 30 dmm.

To further describe and to exemplify the present invention, the following examples are presented. These examples are in no manner to be construed as limiting the present invention. In the following examples the viscosity was determined using ASTM D2170, the penetration by ASTM D5, and softening point by ASTM D2398. Each feed stock was tested for compatibility with ferric chloride by mixing 100 grams of asphalt with 5 grams of ferric chloride at 450 degrees Fahrenheit for 15 minutes and then visually checking whether it separated into two phases. If it separated into two phases, it fails the test and will not form an industrial asphalt using the one-step process of the present invention.

EXAMPLES

EXAMPLE 1 a 200 g sample of a 70/30 blend of vacuum distilled asphalt from California Coastal crude oil and a petroleum gas oil distillate having a penetration at 77 degrees Fahrenheit of 119 dmm, a viscosity at 212 degrees Fahrenheit of 2162 cSt, a viscosity at 350 degrees Fahrenheit of 61 cSt, and a ring and ball softening point of 117 degrees Fahrenheit, was heated to 325 degrees Fahrenheit with slow stirring and nitrogen injection. To the asphalt was slowly added 16.5 ml (10.0 gm ferric chloride) of 40% aqueous ferric chloride. Stirring speed was increased to about 850 rpm and the temperature was raised to 450 F. Stirring with nitrogen injection was continued for 20 minutes. The product has a penetration at 77 of 23 dmm, a viscosity at 350 of 280 cSt and a softening point of 186 degrees Fahrenheit.

EXAMPLE 2–8

The procedure of Example 1 was followed using other feed stocks or fluxes. Table I shows the properties of various feeds, the experimental conditions, and the results.

TABLE I

| EXAMPLE | Feed Stock (1) | | | Ferric Chloride | Feed and Product Properties | | | |
|---|---|---|---|---|---|---|---|---|
| | | | | | Temp | Pen (2) | S.P. (3) | Vis. (4) |
| NO. | Type | Vis. (4) | Feed Test (5) | Wt. % | F. | dmm | F. | cSt |
| 2 | Boscan | 156 | pass | 0 | — | 31 | 138 | 156 |
| | Boscan | | | 5.0 | 450 | 5 | 219 | 1505 |
| 3 | Calif. | 61 | pass | 0 | — | 119 | 117 | 61 |
| | Calif. | | | 8.0 | 450 | 15 | 211 | 986 |
| | Gilsonite | 135 | pass | 0 | — | 42 | 163 | 135 |
| 4 | Gilsonite | | | 0.35 | 425 | 38 | 174 | 350 |
| 5 | Gilsonite | | | 0.5 | 425 | 36 | 186 | 268 |
| 6 | Gilsonite | | | 1.0 | 425 | 32 | 201 | 462 |
| 7 | Gilsonite | | | 1.25 | 410 | 17 | 232 | 2511 |

TABLE I-continued

| EXAMPLE NO. | Feed Stock (1) Type | Vis. (4) | Feed Test (5) | Ferric Chloride Wt. % | Feed and Product Properties Temp F. | Pen (2) dmm | S.P. (3) F. | Vis. (4) cSt |
|---|---|---|---|---|---|---|---|---|
| 8 | Alaskan | 46 | fail | 0 | — | 166 | 113 | 46 |
| | Alaskan | | | 5.0 | 450 | 36 | 144 | 107 |

(1) Feed stock description:
(a) Boscan = 85/15 blend of Boscan Distillation Residue/Petroleum Gas Oil Distillate
(b) Calif. = 70/30 California Coastal Crude Residue/Petroleum Gas Oil Distillate
(c) Gilsonite = 50/50 Gilsonite/Petroleum Gas Oil Distillate
(d) Alaskan = Alaskan North Slope Crude Distillation Residue
(2) Penetration in decimillimeters (dmm) measured at 77 F.
(3) Softening point, using ring and ball method
(4) Viscosity at 350 F. in centistokes (cSt)
(5) The 5% ferric chloride test for compatibility

What is claimed is:

1. A one-step method of producing an industrial asphalt from a petroleum residuum consisting essentially of mixing together without air-blowing and in a nitrogen atmosphere:

(a) a feed consisting essentially of a bituminous material having a viscosity of 65 to 180 centistokes at 350 degrees Fahrenheit and wherein said feed forms a single phase when mixed with 5 percent ferric chloride; and (b) from more than 0.5 to less than 10 percent by weight of ferric chloride, said mixing being done at a temperature in the range of 400 to 500 degrees Fahrenheit for from 5 to 25 minutes; whereby the softening point of the asphalt is substantially increased by 70 to 100 degrees Fahrenheit and the penetration is significantly decreased by at least 30 to 60 dmm at 77 degrees Fahrenheit thereby producing an industrial asphalt having a softening point in the range 200 to 235 degrees Fahrenheit and a penetration of 12 to 30.

* * * * *